US006073791A

United States Patent [19]

Reutter

[11] Patent Number: 6,073,791

[45] Date of Patent: Jun. 13, 2000

[54] CLOSURE CAP WITH TEMPERATURE-DEPENDENT UNSCREWING PROTECTION

[76] Inventor: Heinrich Reutter, Theodor-Heuss-Strasse 12, D-71336 Waiblingen, Germany

[21] Appl. No.: 09/214,273

[22] PCT Filed: May 29, 1997

[86] PCT No.: PCT/EP97/02804

§ 371 Date: Dec. 31, 1998

§ 102(e) Date: Dec. 31, 1998

[87] PCT Pub. No.: WO98/00347

PCT Pub. Date: Jan. 8, 1998

[30] Foreign Application Priority Data

Jul. 2, 1996 [DE] Germany ..... 296 11 514 U

[51] Int. Cl.[7] ..... B65D 51/00

[52] U.S. Cl. ..... 220/201; 220/DIG. 17; 220/DIG. 32

[58] Field of Search ..... 220/201, 288, 220/303, 304, DIG. 32, DIG. 33, 203.19, 203.23, 203.24, 203.25, 203.27, 203.28, 203.29, 86.1, 86.2, 88.1, 89.4, DIG. 17

[56] References Cited

U.S. PATENT DOCUMENTS

| | | | |
|---|---|---|---|
| 4,872,584 | 10/1989 | Sakai | 220/201 |
| 4,927,049 | 5/1990 | Giordano | 220/201 |
| 5,845,800 | 12/1998 | Shaw et al. | 220/201 X |

FOREIGN PATENT DOCUMENTS

| | | | |
|---|---|---|---|
| 1641717 | 4/1991 | U.S.S.R. | 220/201 |
| 1687251 | 10/1991 | U.S.S.R. | 220/201 |

*Primary Examiner*—Nathan J. Newhouse
*Attorney, Agent, or Firm*—Jones, Tullar & Cooper, P.C.

[57] ABSTRACT

The invention concerns a preferably screwable or attachable and twistable closure cap for attaching to a fixed spout, for example of a car radiator, a compensating reservoir in cooling or heating systems or the like, with a screw cap or an attachable and twisting cap and a twistable contact part within which preferably an excess/low-pressure combination valve is concentrically mounted on the cap. The valve has a sealing element which comes into tight contact with the fixed part when the closure cap is fastened. The closure cap, when screwed onto the fixed spout, is prevented from being removed or unscrewed or untwisted by means of a temperature-dependent control element in which the temperature-dependent control element (12) creates a coupling of the cap (2) and the contact part (4) when the temperature is normal and a decoupling when the temperature rises. In the area between the contact part (4) and the cap (2) on the top side of the contact part (4) there is a rocking coupling piece (50) which runs essentially in the radial direction of the contact part (4) which, on an axis (52) running parallel to the top side of the contact part (4), is firmly shape-mated with the contact part so that it has limited movement in a to peripheral direction to the contact part and wherein the coupling piece (50) is pressed down by a spring element (62) in the direction of the top (58) of the contact part (4) when the temperature is normal. When the temperature rises the coupling piece (50) is pressed upwards against the spring element (62) using the temperature-dependent control element (34) and thus moved about its displaceable axis (52) so that its radial outer end becomes free and is no longer coupled with the cap (2).

24 Claims, 2 Drawing Sheets

CLOSURE CAP WITH TEMPERATURE-DEPENDENT UNSCREWING PROTECTION

FIELD OF THE INVENTION

The present invention relates to a closure cap, which can be fastened to a fixed connector, for example, a motor vehicle radiator, an expansion tank for cooling or heating devices or the like, preferably by screwing it on or pushing it on and turning it. The closure cap has a screw cap or a push-and-turn cap and a rotatable engagement element, in which a valve, which preferably is embodied as an overpressure/underpressure combination, is arranged concentrically with the cap, wherein the valve has a sealing element which comes into sealing contact with the fixed connector when the closure cap is applied, wherein the closure cap, when applied to the fixed connector, can be secured against removal, preferably against unscrewing or twisting it off, by means of a temperature-dependent control element, in that by means of the temperature-dependent control element a coupling, fixed against relative rotation, between the cap and the engagement element can be achieved at normal temperature, and an uncoupling of the cap from the engagement element at excess temperatures.

BACKGROUND OF THE INVENTION

Such closure caps are used, for example, in motor vehicle cooling systems, either directly as a radiator cap, or as a closure for the expansion tank. Here, the closure cap can either be screwed on by means of a screw thread, or it can be pushed on and rotated by means of a bayonet element. In connection with motor vehicle cooling systems there is a problem in regard to the closure caps in that as a rule the pressure is very high because of the high temperature in the cooling system. Even if at the time the motor is turned off the temperature in the cooling system is not too high, there can be a temperature, and therefore a pressure increase in the cooling system because of a certain amount of residual heating after the motor has been turned off. If the closure cap is removed during this time, there is an acute danger of scalding of the respective user. To counteract this, closure caps with a temperature-dependent unscrewing protection, such as described at the outset, have been developed which, in case of an excessive temperature in the cooling system, do not permit the user to remove the closure cap by actuating the cap, since during excess temperature the cap turns without contact with the engagement element.

A closure cap is known, for example, from Published international application WO 95/32904. With closure caps in accordance with this publication, a temperature-dependent control element constituted by a bimetal element is provided in accordance with a variant in a comparatively voluminous hollow chamber within the cap and above the engagement element, and in accordance with another variant a U-shaped coupling element can be lifted or lowered in the axial direction. Although both embodiments operate satisfactorily, the space between the engagement element and the cover required for this is considerable.

SUMMARY OF THE INVENTION

The object of the present invention is to provide a closure cap of the type mentioned at the outset, wherein the temperature-dependent unscrewing protection is housed in a space-saving manner, so that the cap can be given a compact appearance. The unscrewing protection furthermore is intended not to be prone to trouble and to be mounted in a simple and efficient manner.

This object is attained in connection with a closure cap of the type mentioned at the outset by the provision of a rocker-like coupling element, which essentially extends in the radial direction of the engagement element, is pivotable to a limited extent on an axis extending parallel with the top of the engagement element, and in the circumferential direction of the engagement element is interlockingly connected, fixed against relative rotation, with the engagement element, so that at normal temperatures the one end of the coupling element is pushed down by a resilient element in the direction toward the top of the engagement element, and at excess temperature the coupling element is pushed up by means of a temperature-dependent control element against the force of the resilient element, thereby causing it to be pivoted around the pivot axis so that its radially outer and is released from a coupled position with the cap.

The rocker-like coupling element can be arranged in a space-saving manner between the engagement element and the cap. It can be dependably operated in that a leg of the rocker-like coupling element is pushed away from the top by means of the temperature-dependent control element, so that its other leg is released out of the coupling position with the cap.

The temperature-dependent control element is preferably constituted by a memory spring. Preferably the latter cooperates with a control bolt, which is movable in the axial direction and is supported against the underside of the rocker-like component. Because of this the memory spring can be arranged inside the engagement element, in particular close to the surface of the liquid, and the temperature-dependent control element is therefore in good thermal contact with the interior of the cooling system.

Advantageous further developments of the present invention are described hereinafter and in the claims.

In accordance with a further feature of the present invention, per se independent of the unscrewing protection in accordance with the present invention, brackets, plates or protrusions are provided on the inside of the wall of the cap essentially shaped in the form of a cylinder jacket, which essentially extend in the radial direction and are slightly resilient and which, with the insertion of the engagement element into the cap, are slightly bent outward and in this way maintain the cap and the engagement element against each other free of play or vibration. Rattling of the engagement element in the cap is prevented in this way.

Further characteristics, details and advantages of the present invention ensue from the claims as well from a drawing representation and subsequent description of a preferred embodiment of the closure cap. Shown in the drawing are:

FIG. 1, which is a longitudinal sectional view along the longitudinal axis of a closure cap in accordance with the present invention, FIG. 2, is an enlarged section of FIG. 1 with a rocker-like coupling element, and FIG. 3, is a top view of the closure cap in FIG. 1.

DESCRIPTION OF THE PREFERRED EMBODIMENTS

Figure 1:
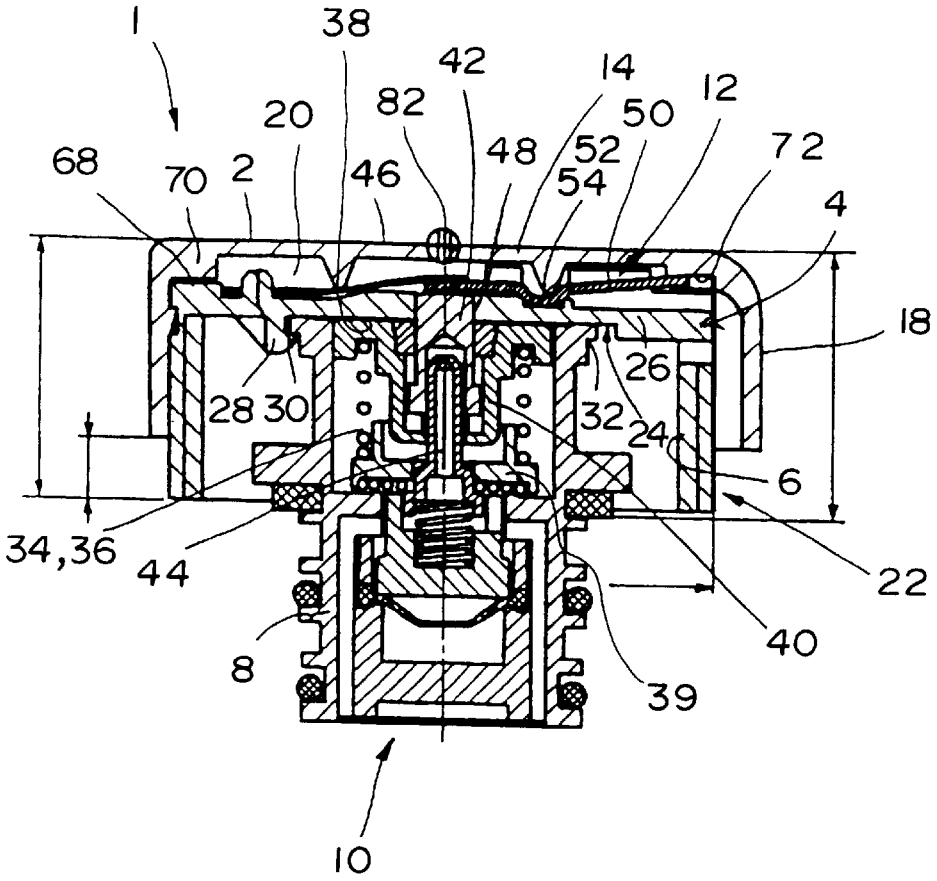

The drawing figures represent a closure cap, identified as a whole by the reference numeral 1, having a cap 2, an engagement element 4, which is rotatable with respect to the cap and has a section with an inner thread 6, and a valve unit 10 housed in a valve housing 8, as well as a temperature-dependent unscrewing protection 12, by means of which coupling, or respectively uncoupling, fixed against relative rotation, between the cap 2 and the engagement element 4 can be achieved.

Figure 3:
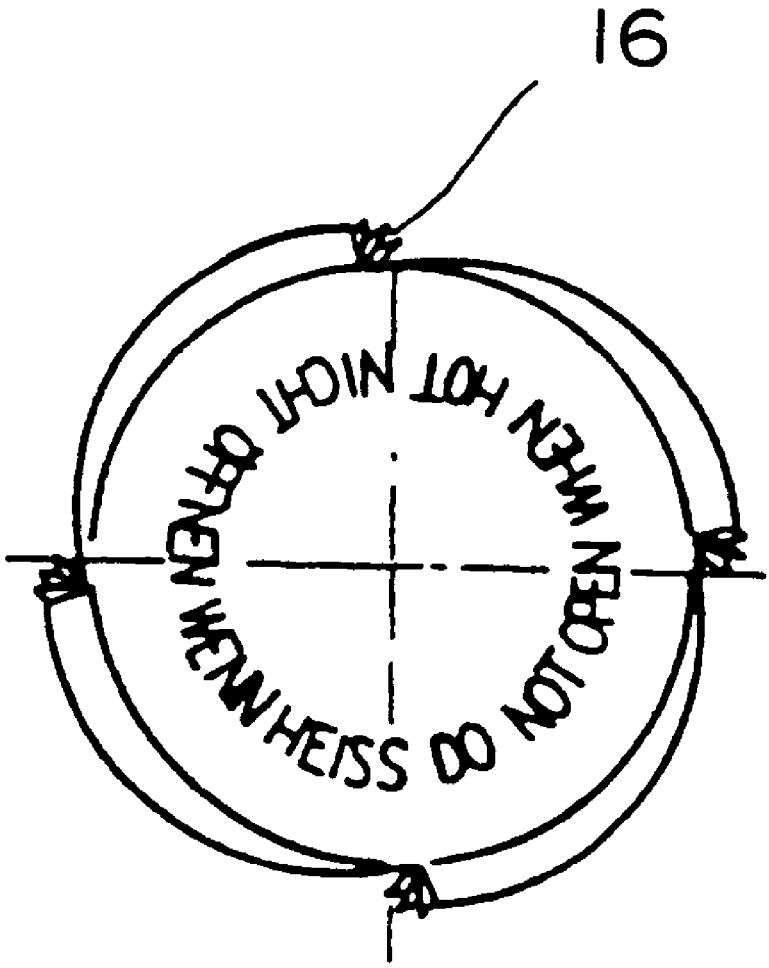

The cap 2 has a flat-shaped wall area 14 extending essentially level and transversely with respect to the plugging direction, and a wall area 18 pointing downward in a flange-like manner, which slightly deviates from the cylinder shape for forming support surfaces 16 (FIG. 3). In the assembled state of the cap 2 and the engagement element 4, the cap 2 extends nearly completely over the engagement element 4, so that only a comparatively small space 20, narrow in the axial direction, exists between the cap 2 and the engagement element 4.

Corresponding to the cap 2, the engagement element 4 is designed to be cup-shaped, wherein the threaded section 6 is provided as an interior thread on the inside of the flange-like jacket section 22. The closing cap 1 is screwed with this threaded section 6 onto a fixed connector of a motor vehicle radiator or expansion tank. When screwed onto the fixed connector, the connector, not represented in the drawings, extends between the valve housing 8 and the jacket section 22 of the engagement element 4. The valve housing 8 is lockingly maintained on the underside 24 of a cap section 26 of the cup-shaped engagement element 4. Downwardly projecting holding elements 28 are provided on the underside 24, which are offset by respectively 90 degrees from each other, can be slightly deflected in the radial direction and have a projection 30 which can be gripped from behind and with which an upper ring flange 32 of the valve housing 8 can be locked, or respectively clipped to it.

Figure 2:
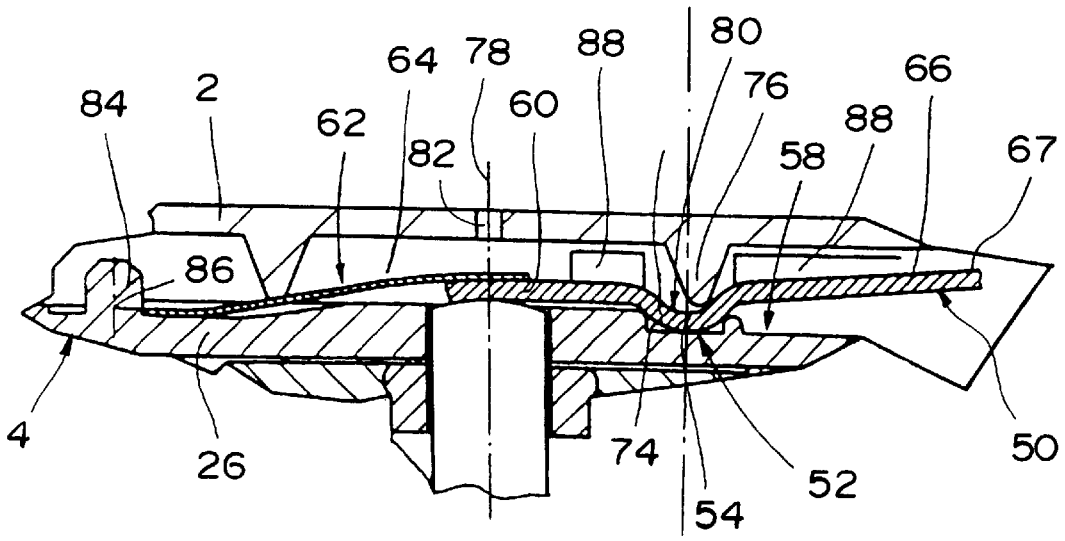

A temperature-dependent control element 34 in the form of a memory spring 36 is provided inside the valve unit 10 which, as an underpressure/overpressure valve, is basically known and is therefore not described in detail. The memory spring 36 is supported against a bottom 38 of a cup-shaped component 40, which in turn is held in the valve housing 8. With its other end, the memory spring 36 pushes against a control bolt 42, which is guided, displaceable in the axial longitudinal direction, on a hollow pin 44 extended through a wall 38. The memory spring 36 is arranged around this pin 44. The control bolt 42 projects through a central opening 48 in the cap section 26 of the engagement element 4 with its end facing away from the memory spring 36, and rests against the underside of a rocker-shaped coupling element 50. The rocker-shaped coupling element 50 is a resilient sheet metal element and is essentially embodied in a strip shape; it has a bead-like bend 54, which forms a pivot axis 52, with which the coupling element 50 rests in a recess 56 on the top 58 of the engagement element 4. A resilient element 62 in the form of a leaf spring 64 rests from above on the leg 60 of the coupling element 50, against whose underside the control bolt 42 rests, and attempts to push the leg 60 downward in the direction toward the top 58 of the engagement element 4, because of which the leg 66 of the coupling element 50 located on the other side of the pivot axis 52 is pivoted upward and presses with its end 67 against the underside 68 of an annular collar or annular flange 70 (FIG. 1) at the inside of the cap 2. The annular collar or flange 70 has at least one cutout 72 into which, when the cap 2 is appropriately positioned with respect to the engagement element 4, the end 67 of the leg 66 of the rocker-like coupling element 50 can extend, and in this way can cause a coupling, fixed against relative rotation, between the cap 2 and the engagement element 4. The state of the unscrewing protection just described and represented in FIGS. 1 and 2 occurs at normal temperature, when the leaf spring 64 presses the radially inner leg 60 of the coupling element 50 downward. At an excess temperature in the interior of the radiator housing, the memory spring 36 is heated and expands in the longitudinal direction. It pushes the control bolt 42 upward against the effects of the leaf spring 64, by means of which the rocker-like coupling element 50 is slightly tilted or pivoted around the pivot axis 52. Because of this the end 67 of the radially outer leg 66 of the coupling element 50 pivots downward and is free from the cutout 72 in the annular flange 50, so that the cap 2 turns without contact with the engagement element 4. The unscrewing protection 12 is effective; the closure cap 1 cannot be removed from the fixed connector.

Although in the assembled state of the cap 2 and the engagement element 4, the rocker-shaped coupling element 50 can be tilted around the pivot axis 52, it is arranged captively in the space 20 between the top 58 of the engagement element 4 and the cap 2. The already mentioned cutout 56 is provided to this end, against whose bottom 74 the bead-shaped area 54 rests. An annular projection 76 is arranged on the cap 2 opposite the cutout 56 in the axial direction, which extends concentrically with respect to the axial longitudinal direction 78 of the closure cap. This annular projection 76 enters from above into the rear curve 80 of the bead-shaped bent area 54 and prevents the coupling element 50 from being released out of the cutout 56 or sliding out of it, for example when the closure cap 1 is upended.

Finally, an opening 82 is provided in the cap 2, which can be penetrated by a thin wire or the like in the axial longitudinal direction, in order to be able to push the leg 60 of the coupling element 50 downward in case of a defect in the unscrewing protection 12, and in this way to achieve a coupling, fixed against relative rotation, between the cap 2 and the engagement element 4.

Wall sections, or ribs which protrude on both sides of the coupling element 50 from the top 58 of the engagement element 4 upward and extend in the radial direction, and transfer the torque introduced from the exterior from the coupling element to the engagement element 4, have been provided with the reference numeral 88.

Furthermore, a pin 84 projects from the top 58 of the engagement element 4, which extends through an opening 86 in the leaf spring 64 and positions it in this way.

Finally, FIG. 3 represents a view from above on the closure cap, by means of which the support surfaces of the cap 2 can be seen.

What is claimed is:

1. A closure cap for fastening to a fixed connector by one of: screwing it on, and pushing it on and turning it relative to the fixed connector, comprising:

a cap;

a rotatable engagement element connected to said cap, said rotatable engagement element defining a top and a radial direction;

a valve arranged concentrically with at least said cap, said valve having sealing means which come into sealing contact with the fixed connector when the closure cap is applied to the fixed connector;

a rocker-like coupling situated between said cap and said rotatable engagement element, and extending essentially in said radial direction, said rocker-like coupling defining, in said radial direction, one end, a further end and a pivot axis with respect to said rotatable engagement element, said further end engaging said cap as a function of the temperature in the fixed connector;

a resilient element situated between said cap and said rotatable engagement element and in engagement with said rocker-like coupling for pushing down said rocker-like coupling at said one end thereof in the direction toward said top while said further end engages said cap; and a temperature-dependent control element situated to react to the temperature in the fixed connector to control the securement of the closure cap to the fixed connector such that said cap is fixed against relative rotation with respect to said relative rotation element when the temperature in the fixed connector is below a given level and is uncoupled from said rotatable engagement element when the temperature in the fixed connector is at or above said given level, wherein:

said temperature-dependent control element causes a force to be exerted against said rocker-like coupling in a direction opposing the force resulting from said resilient element pushing down said rocker-like coupling at said one end thereby causing said rocker-like coupling to pivot about said pivot axis and said further end to move out of engagement with said cap, when the temperature in the fixed connector is at or above said given level.

2. The closure cap as defined in claim 1, wherein the fixed connector is one of: a motor vehicle radiator, and an expansion tank of cooling or heating devices.

3. The closure cap as defined in claim 1, wherein said cap is one of: a screw cap, and a push-and-turn cap.

4. The closure cap as defined in claim 1, wherein said valve is an overpressure/underpressure valve.

5. The closure cap as defined in claim 1, wherein said cap defines a concentric annular collar having at least one cutout, and wherein said further end engages said annular collar and slides in the circumferential direction relative thereto when the temperature in the fixed connector is at or above said given level and said cap is rotated, and engages said cutout when the temperature in the fixed connector is below said given level and said cap is secured against rotation.

6. The closure cap as defined in claim 1, wherein said temperature-dependent control element comprises a memory spring.

7. The closure cap as defined in claim 1, wherein said rocker-like coupling element comprises a metal strip having a bead-shaped section defining said pivot axis.

8. The closure cap as defined in claim 1, wherein said rocker-like coupling element comprises a resilient metal element having a bead-shaped section defining said pivot axis.

9. The closure cap as defined in claim 1, wherein said cap includes at least one annular-shaped projection which extends toward and engages said top.

10. The closure cap as defined in claim 1, wherein said rocker-like coupling element defines an underside, and wherein said valve includes a control bolt which engages said underside of said rocker-like coupling element, said control bolt acting together with said temperature-dependent control element to move in an axial direction in its engagement with said underside.

11. The closure cap as defined in claim 10, wherein said rotatable engagement element defines an axial opening, said temperature-dependent control element and said control bolt are arranged inside of said rotatable engagement element, and wherein said control bolt extends through said axial opening.

12. The closure cap as defined in claim 11, wherein said temperature-dependent control element and said control bolt are centered inside of said rotatable engagement element.

13. The closure as defined in claim 1, wherein said cap has a flange-shaped wall provided on the inside thereof with one of: a brackets, plates and protrusions, which extend radially and are slightly resilient, and which with the insertion of said rotatable engagement element into said cap are slightly bent outward and thus maintain said cap and said rotatable engagement element against each other free of play and vibration.

14. The closure cap as defined in claim 13, wherein said brackets, plates and protrusions are formed onto an inner annular flange of said cap.

15. The closure cap as defined in claim 13, wherein said brackets, plates and protrusions have an inclination at their lower end for allowing engagement of said rotatable engagement element during assembly.

16. The closure cap as defined in claim 1, wherein said rotatable engagement element has a cutout extending into said top in which said bead-shaped section is seated.

17. The closure as defined in claim 16, wherein said cap includes at least one annular-shaped projection which extends toward and engages said cutout extending into said top.

18. The closure cap as defined in claim 16, wherein said rotatable engagement element includes at least one rib projecting from said top in the axial direction toward said cap, said at least one rib being engaged by said rocker-like coupling element.

19. The closure cap as defined in claim 18, wherein said at least one rib rests against the underside of said cap.

20. The closure cap as defined in claim 1, wherein said resilient element comprises a leaf spring.

21. The closure cap as defined in claim 20, wherein said leaf spring extends generally parallel to said top.

22. The closure cap as defined in claim 21, wherein said leaf spring is mounted on said rotatable engagement element to be fixed against relative rotation.

23. The closure cap as defined in claim 22, wherein said leaf spring is mounted on said rotatable engagement element to be fixed against relative rotation by an interlock.

24. The closure cap as defined in claim 23, wherein an opening is formed in said leaf spring, said top includes a pin-shaped protrusion that extends through said opening for positioning said leaf spring in the radial direction.

* * * * *